United States Patent [19]

Ossiani

[11] Patent Number: 5,042,116

[45] Date of Patent: Aug. 27, 1991

[54] MAGNETIC CLOSING BUTTON FOR HANDBAGS AND THE LIKE

[75] Inventor: Bruno Ossiani, Milano, Italy

[73] Assignee: Metal Shearing S.n.c., Italy

[21] Appl. No.: 561,444

[22] Filed: Aug. 2, 1990

Related U.S. Application Data

[63] Continuation-in-part of Ser. No. 330,054, Mar. 29, 1989, abandoned.

[30] Foreign Application Priority Data

May 23, 1988 [IT] Italy ..... 21281/88[U]

[51] Int. Cl.[5] ..... A44B 21/00

[52] U.S. Cl. ..... 24/303; 292/251.5

[58] Field of Search ..... 292/251.5; 63/29.2; 24/49 M, 303; 335/285; 248/206.5

[56] References Cited

U.S. PATENT DOCUMENTS 3,372,443 3/1968 Daddona, Jr. ..... 24/303

4,231,137 11/1980 Fujimoto ..... 24/303

4,453,294 6/1984 Monta ..... 24/303

FOREIGN PATENT DOCUMENTS 106808 6/1983 Japan ..... 335/285

112304 7/1983 Japan ..... 335/285

*Primary Examiner*—James R. Brittain

*Attorney, Agent, or Firm*—Laff, Whitesel, Conte & Saret

[57] ABSTRACT

The magnetic button comprises a male element 2 and a female element 3 respectively fastened to two different parts of a handbag or the like. The female element 3 consists of a magnetic ring 12 enclosed in a case 13 which is secured to a plate 8 having a female pin 11 disposed in coaxial relation with the magnetic ring. The male element 2 has a plate 4 designed to go in abutment against the cage 13 and provided with a male projection pin 16 adapted to be housed in the magnetic ring 12 in female member defined by the cage. The male projecting pin 16 is provided with a recess 7 that houses the female pin 11 when the button is closed.

1 Claim, 2 Drawing Sheets

FIG. 2
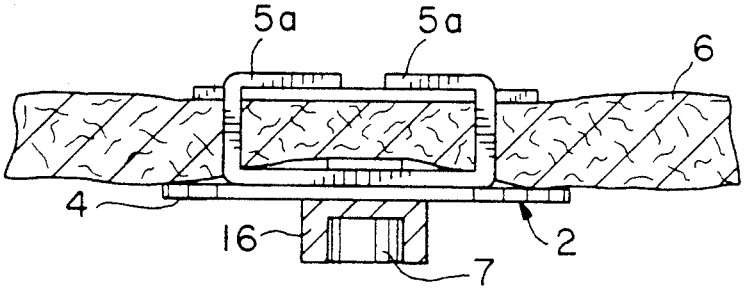
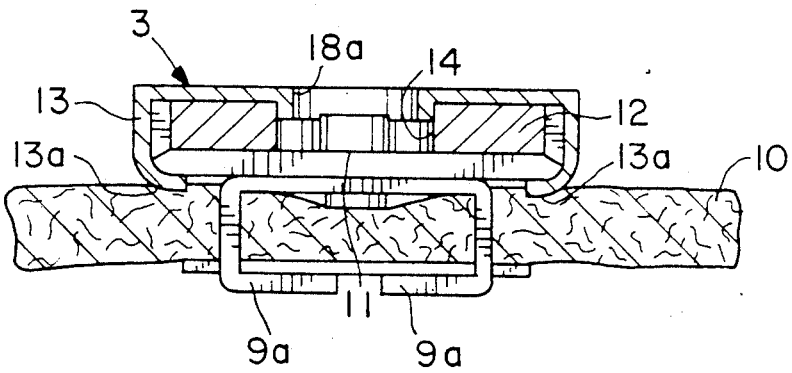
FIG. 3

MAGNETIC CLOSING BUTTON FOR HANDBAGS AND THE LIKE

The present invention is a continuation-in-part of my copending application Ser. No. 07/330,054 filed Mar. 29, 1989 abandoned.

The present invention relates to a magnetic closing button for handbags and the like. More particularly, the magnetic closing button of the invention is not only applied to handbag but it can also be advantageously applied to brief-cases, belts, leather-made garments and leather articles, whenever it is necessary to temporarily and detachably fasten two distinct parts of a handbag brief-case or garment.

PRIOR ART

Magnetic closing buttons performing the above functions have been commercially available for a long time. In a number of embodiments studied, their purpose is to optimize production costs, making the assembling of the two component parts easier and achieving an increasingly efficient mutual locking between the parts to be joined together.

Magnetic closing buttons presently on the market generally have a male element, fastened to the flap, in the case of bags, handbags, brief-cases and the like, and a female element fastened to the relatively stationary portion of the handbang "dial". These type of buttons are generally described in the Morita U.S. Pat. 4,453,294.

The male element essentially comprises a plate provided on one side thereof with a clip to allow it to be hooked to the handbag and on the opposite side with a projecting pin. In turn, the female element substantially comprises a plate which is also provided, on one side thereof, with a clip to allow it to be hooked to the handbag "dial" and on the other side with a dowel permitting the introduction of a magnetic ring designed to match, by magnetic attraction, with the plate of the female element. In order to prevent the magnetic ring from being for any reason detached from the plate of the female element, provision is also made for a fastening cage to lock the magnetic ring between the plate and the cage itself. In addition, the latter is provided with a central hole to allow the pin of the male element to be introduced into the female element when the button is being closed.

The magnetic buttons structured as above described have proved to be advantageous from some points of view. They are for example, handy in that their opening and closing operations can be carried out very easily. However, they have some drawbacks which relate to the ease with which they can be opened and closed. More particularly, it is to be pointed out that the surfaces of the male and female elements in contact with each other during the opening step can be subjected to mutual sliding and can be moved apart from each other thereby bringing about the opening of the handbag by means of easy rotational movements which do not need any effort by a person opening the handbag.

Under this situation, this type of closing can involve serious consequences in crowded environments, such as stations, public transport means, etc. where thieves and ill-disposed people wish to carry out pick-pocket actions.

In order to avoid this drawback, some manufacturers of magnetic buttons have studied the addition of auxiliary elements such as tabs, undercuts, hooks and the like to the structure of the buttons, so that the opening of a magnetic button may take place by means of relative movements of the male element with respect to the female element according to an axis at right angles to the contact surfaces, that is according to the direction in which magnetic forces exert the greatest attraction and therefore involve the maximum effort in opening the button.

All the above contrivances which, on the one hand, have proved to be efficient above all in making pick-pocket actions difficult to thieves and ill-disposed people, have on the other hand have inevitably made the magnetic button structure heavier, as regards both construction and assembling, bringing about, as a result, an increase in prices.

SUMMARY OF THE INVENTION

The main object of the present invention is to provide a magnetic closing button for handbags and the like which, on the one hand, is very simple and therefore advantageous from the point of view of its construction and cost and, on the other hand, ensures that the opening and closing operations of the button take place only by means of movements at right angles to the contact surfaces of the male and female elements.

The foregoing and further object of the present invention, is to provide a magnetic closing button for handbags and the like comprising a male element, the male element having a male plate with two opposite sides, a first hooking clip extending from one side of the male plate and a male projecting pin projecting from the opposite side of the male plate; the male projection pin defining a recess therein; a female element, the female element having a female plate with two opposite sides, a second hooking clip extending from one side of the female plate and a female projection pin projecting from the opposite side of the female plate; the female projection pin being sized to be housed an retained by the recess; a magnetic ring having a central hole, the magnetic ring being mounted on the one side of the female plate with the central hole surrounding the female projection pin; a fastening cage attaching the magnetic ring to the female plate, the fastening cage defining a central female member having sides adapted to project into the magnetic ring central hole; the female member sides are spaced a predetermined distance from the female projection pin and forming the female member of the female element; the female member being sized to house and retain the male projecting pin; the male and female projection pins being disposed in coaxial relationship with each when the button is closed; a diameter of the male projecture pin recess and a diameter of the female projection pin are substantially equal; and wherein when closed, the male projection pin is within the magnetic ring hole and the female projection ring projects int the male projection recess and is retained thereby.

BRIEF DESCRIPTION OF THE DRAWINGS

Further features and advantages of the invention will best be understood from the detailed description of a preferred embodiment of the invention given hereinafter by way of non limiting example with reference to the accompanying drawings, in which:

FIG. 2 is a partial cross-sectional view of male element of the magnetic closing button of FIG. 1 as applied to a handbag or the like.

FIG. 3 is a partial cross-sectional view of a female element of the magnetic closing button of FIG. 1 as applied to a handbag or the like.

DESCRIPTION OF THE PREFERRED EMBODIMENTS

Figure 1:
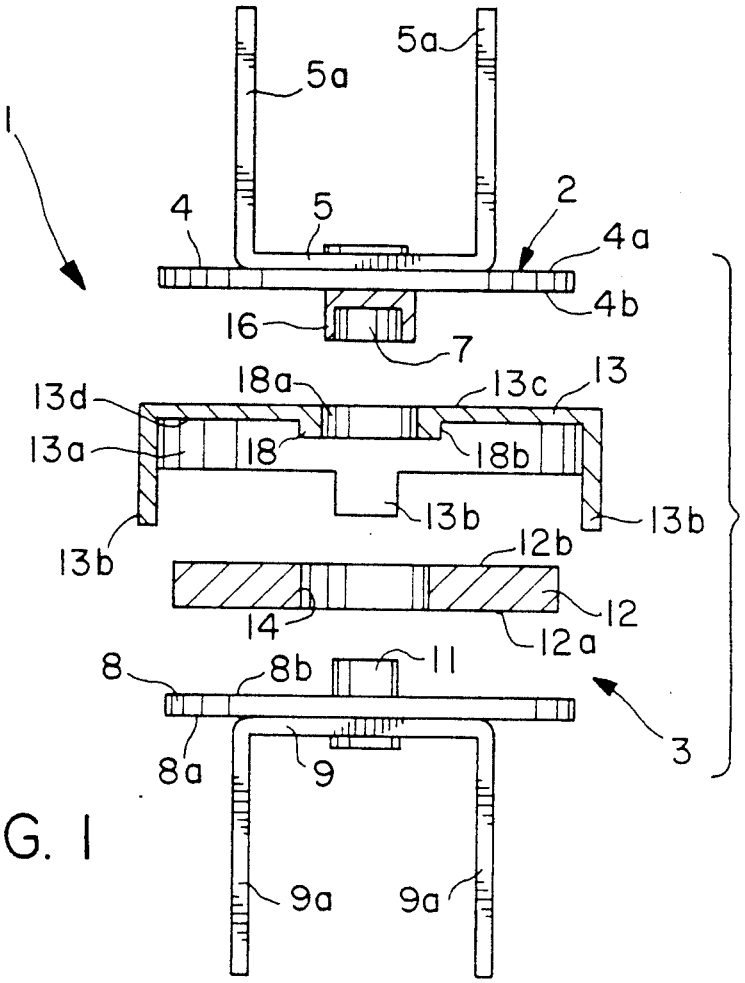
FIG 1 is a partial sectional side view of the magnetic closing button of the present invention in an exploded separated condition.

Referring to FIGS. 1, 2 and 3, 1 globally denotes a magnetic closing button for bags, handbags, brief-cases and garments in general.

The magnetic closing button 1 has a male element globally identified at 2 and a female element globally identified at 3.

As clearly seen in the figures, the male element 2 comprises a cylindrical plate 4 having two opposite sides 4*a* and 4*b*. A U-shaped hooking clip 5 extends generally centrally from one side 4*a* thereof. The clip 5 is designed to be fastened through its generally rectangular folding arms 5*a*, to one portion 6 of a handbag and the like such as for example the flap.

On its side 4*b* opposite that carrying the clip 5, the plate 4 has a cylindrical male projecting pin 16. The male projecting pin 16 has a recess or partial bore 7. The recess 7 is preferably of a cylindrical shape.

The female element 3 consists of a cylindrical female plate 8 with two opposite sides 8*a* and 8*b*. A U-shaped hooking clip 9 extends generally centrally from one side 8*a* thereof. The clip 9 is designed to be fastened through generally rectangular arms 9*a* to another portion lo of the handbag or brief-case which is capable of being placed in opposition to the preceding portion 6 such as for example the "dial".

The other side 8*b* of the plate 8 opposite that carrying the clip 9 has a cylindrical projection or female pin 11 extending centrally therefrom. A magnetic ring 12 has substantially flat ends 12*a* and 12*b*.

The magnetic ring 12 has a central hole 14 that has a diameter larger than the diameter of the male projection pin 16 and the female projection pin 11. The length of the central hole 14 is slightly longer than the female projection pin 11.

A cylindrical fastening cage 13 has a cylindrical end wall 13*a* having a plurality of fastening folding hooking tabs 13*b* extending therefrom. The cage 13 has a cylindrical top wall 13 with a generally circular or cylindrical female member 18 being formed in the center of the top wall 13*c*. The female member is cylindrical and is formed as part of the top wall 13. The female member has an inner cylindrical wall 18*a* defining a hole that extends below the inner surface 13*d* of the front wall 13. The portion of the female member that extends below the front wall has an outer cylindrical wall 18*b* that has a diameter which is preferably substantially equal to the diameter of the magnetic ring hole 14 to form an interferrence fit therewith. The cylindrical wall 18*b* is sized and adapted to project into the magnetic ring central hole.

Figure 4:
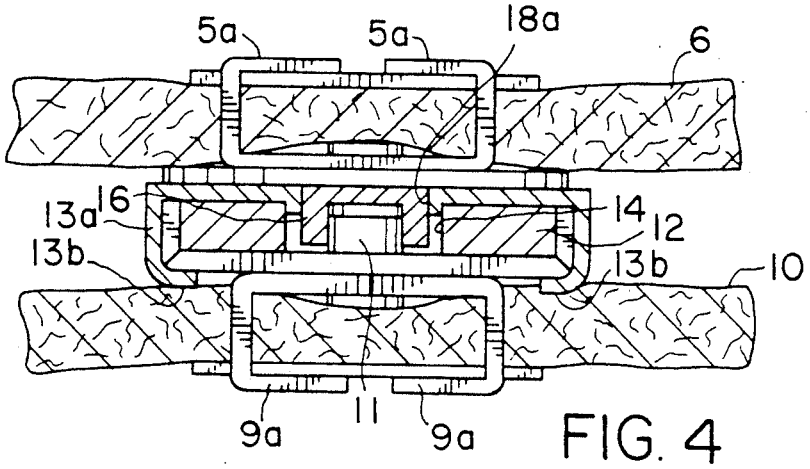
FIG. 4 is a partial cross-sectional view of the magnetic closing button of FIG. 1 as applied to a handbag or the like, when closed.

As shown in FIG. 4, the cage 13 holds the magnetic ring 12 onto the female plate 8 by folding the hooking taps 13*b* over the perimeter and under the plate 8 and preferably contacting the end face 8*a*.

The length of the male recess 7 is preferably less than the length of the female projecting pin 11. The diameter of the recess 7 is substantially equal to the diameter of the female projection pin 11 and when the button is closed, the male projection pin 16 and the female projection are disposed in coaxial relationship with each other when the bottom is closed.

The outer diameter of the projection pin 16 is substantially equal to the diameter of the female member inner cylindrical wall 13*a*.

Advantageously, as viewed in FIG. 4, during the introduction of male pin 16 into female member hole, the recess 7 provided in pin 16 ensheathes female pin 11 of the female element 3 so that the mutual engagement and disengagement between the male 2 and female 3 elements can only take place through relative movements involving the coaxial displacement of one element with respect to the other. To this end, advantageously and in accordance with another feature of the present invention, the inner diameter of recess 7 and the diameter of female pin 11 are substantially identical with respect to each other or have such a difference that, when mutually coupled, only a positive allowance between the parts exists.

Assembling and operation of the magnetic closing button according to the invention described above mainly as regards structure, is very simple.

Being stated that the female element 3 will be commercially available already assembled. The magnetic ring 12 is already locked on plate 8 by means of cage 13. It is sufficient to make arms 5*a* and 9*a* of clips 5 and 9 enter suitable holes arranged on flap 6 and dial 10 respectively, of the handbag or brief-case and fold the ends of the arms to substantially form a right angle so as to achieve the locking of the female and male elements to the respective portions of the handbag. At this point, to close the handbag it is sufficient to move the flap 6 close to the dial 10 of the handbag and introduce the male element pin 16 into female hole 18*a* formed in cage 13. The magnetic ring 12 is in place. The male pin 16 enters the female element 18 being externally guided by hole 18*a* and internally guided by the female pin 11 which enters hole 7 in pin 16.

In order to open the flap 6 the user must exert a pulling action according to an axis at right angles to the contact planes of the magnetic button 1 since possible rotatory movements or movements performed in other directions would be prevented by jamming of pin 1 in hole 7 which, as a result, makes it impossible to open the magnetic button.

The invention attains the intended purposes.

In fact, it is immediately noted that, thanks to the structural configuration of the magnetic closing button of the invention, the opening of the handbag by ill-disposed people is substantially prevented even in cases of very crowded environments, due to the fact that in order to open the handbag it is necessary to exert an action according to a predetermined direction which obviously cannot be searched for by an ill-disposed person without the involved person becoming aware of it.

Another important advantage achieved with the present invention resides in that the concerned magnetic closing button, as compared with more traditional magnetic buttons of easy construction, does not need additional parts or elements to attain the required safety degree and, as a result, it is of easy Obviously, many modifications and variations can be made to the structure of the magnetic closing button of the invention without departing from the scope of the inventive idea characterizing it.

What is claimed is:

1. A magnetic button for handbags and the like comprising:

male element, said male element having a male plate with two opposite sides, a first hooking clip extending from one side of said male plate and a male projection pin extending from the opposite side of said male plate; said male projection pin defining a recess therein;

a female element, said female element having a female plate with two opposite sides, a second hooking clip extending from one side of said female plate and a female projection pin projecting from the opposite side of said female plate;

said female projection pin being sized to be housed and retained by said recess;

a magnetic ring having a central hole, said magnetic ring being mounted on the opposite side of said female plate with the central hole surrounding said female projection pin;

a fastening case attaching said magnetic ring to said female plate, said fastening cage defining a central female member having sides adapted to project into said magnetic ring central hole; said female member sides are spaced a predetermined distance from said female projection pin and forming said female member of said female element; said female member being sized to house and retain said male projection pin; said male and female projection pins being disposed in a coaxial relationship with each when the button is closed; and a diameter of said projection pin recess and a diameter of the female projection pin are substantially equal; wherein when said butt-on is closed, said male projection pin is within the magnetic ring hole and said female projection pin projects into said male projection recess and is retained thereby.

* * * * *